US009720357B2

(12) United States Patent
Ujiie

(10) Patent No.: US 9,720,357 B2
(45) Date of Patent: Aug. 1, 2017

(54) FIXING DEVICE FOR AN IMAGE FORMING APPARATUS

(71) Applicant: Masateru Ujiie, Kanagawa (JP)

(72) Inventor: Masateru Ujiie, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/139,812

(22) Filed: Apr. 27, 2016

(65) Prior Publication Data

US 2016/0363898 A1 Dec. 15, 2016

(30) Foreign Application Priority Data

Jun. 10, 2015 (JP) ..... 2015-117734

(51) Int. Cl.
*G03G 15/20* (2006.01)

(52) U.S. Cl.
CPC . *G03G 15/2025* (2013.01); *G03G 2215/2032* (2013.01)

(58) Field of Classification Search
CPC ..... G03G 15/2085; G03G 15/2025; G03G 2215/2032
See application file for complete search history.

(56) References Cited

U.S. PATENT DOCUMENTS 5,678,134 A * 10/1997 Miki ..... G03G 15/161 15/1.51
7,949,275 B2 * 5/2011 Kato ..... G03G 21/0029 399/350
2008/0038026 A1 * 2/2008 Ai ..... G03G 15/2025 399/328
2008/0038027 A1 * 2/2008 Ito ..... G03G 15/2025 399/328
2012/0087702 A1 * 4/2012 McNamee ..... G03G 15/2025 399/327
2013/0266353 A1 * 10/2013 Chikugo ..... G03G 15/2064 399/329
2014/0212188 A1 * 7/2014 Watanabe ..... G03G 15/2028 399/323

FOREIGN PATENT DOCUMENTS

| | | |
|---|---|---|
| JP | 2010-191275 | 9/2010 |
| JP | 2014-149344 | 8/2014 |
| JP | 2014-164074 | 9/2014 |
| JP | 2014-174528 | 9/2014 |
| JP | 2014-215376 | 11/2014 |

* cited by examiner

*Primary Examiner* — Francis Gray
(74) *Attorney, Agent, or Firm* — Harness, Dickey & Pierce, P.L.C.

(57) ABSTRACT

A fixing device includes a fixing member, a member disposed opposite the fixing member, a rubbing member, a detector, and a rubbing operation controller. The fixing member fixes a toner image on a recording medium. The rubbing member rubs the fixing member to maintain a surface of the fixing member in optimum condition of the fixing member. The detector detects vibration of the rubbing member. The rubbing operation controller controls rubbing the fixing member with the rubbing member. The rubbing operation controller controls a rubbing rotation speed and a rubbing force in response to at least the vibration of the rubbing member as a trigger.

20 Claims, 4 Drawing Sheets

FIXING DEVICE FOR AN IMAGE FORMING APPARATUS

CROSS-REFERENCE TO RELATED APPLICATIONS

This patent application is based on and claims priority pursuant to 35 U.S.C. §119 to Japanese Patent Application No. 2015-117734, filed on Jun. 10, 2015, in the Japan Patent Office, the entire disclosure of which is hereby incorporated by reference herein.

BACKGROUND

Technical Field

Exemplary aspects of the present invention relate to a fixing device that fixes a toner image on a recording medium, and an image forming apparatus including the fixing device.

Related Art

In related-art image forming apparatuses, a surface of a fixing belt as a fixing member in a fixing device is rubbed and polished to maintain a surface of the fixing member in optimum condition of the fixing member, thus preventing generation of a poor-quality image having streaks caused by an edge of a sheet (a recording medium) conveyed by the fixing member.

To eliminate glossy streaks caused by the sheet edge, it is desired that the surface of the fixing belt should be aggressively abraded to make the entire surface of the fixing belt rough. A roller with a surface that has a polishing function is often used as a member for rubbing and polishing the surface of the fixing belt. In this patent specification, such a roller is called "a polishing roller".

An electrophotographic image forming apparatus includes a fixing device that fixes a toner image on a recording medium. In the fixing device, the recording medium bearing an unfixed toner image passes a fixing nip between a fixing member and a pressure member, so that the toner image is fixed on the recording medium with heat and pressure. When this type of the fixing device feeds a recording medium having a predetermined width, an edge of the recording medium passes a certain area. Accordingly, as long as the recording media have substantially the same size, the edge of each recording medium passes the same area of the fixing member. Moreover, an edge of a sheet includes a burr that is generated when the sheet is cut. The sheet edges including the burrs also pass the same area of the fixing member. Consequently, the fixing member has a surface including the area through which the sheet edges including the burrs pass, and such an area of the surface becomes rough, causing unevenness and streaks in an image and degrading image quality.

SUMMARY

In at least one embodiment of this disclosure, there is provided an improved fixing device that includes a fixing member, a member disposed opposite the fixing member, a rubbing member, a detector, and a rubbing operation controller. The fixing member fixes a toner image on a recording medium. The rubbing member rubs the fixing member to maintain a surface of the fixing member in optimum condition of the fixing member. The detector detects vibration of the rubbing member. The rubbing operation controller controls rubbing the fixing member with the rubbing member. The rubbing operation controller controls a rubbing rotation speed and a rubbing force in response to at least the vibration of the rubbing member as a trigger.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
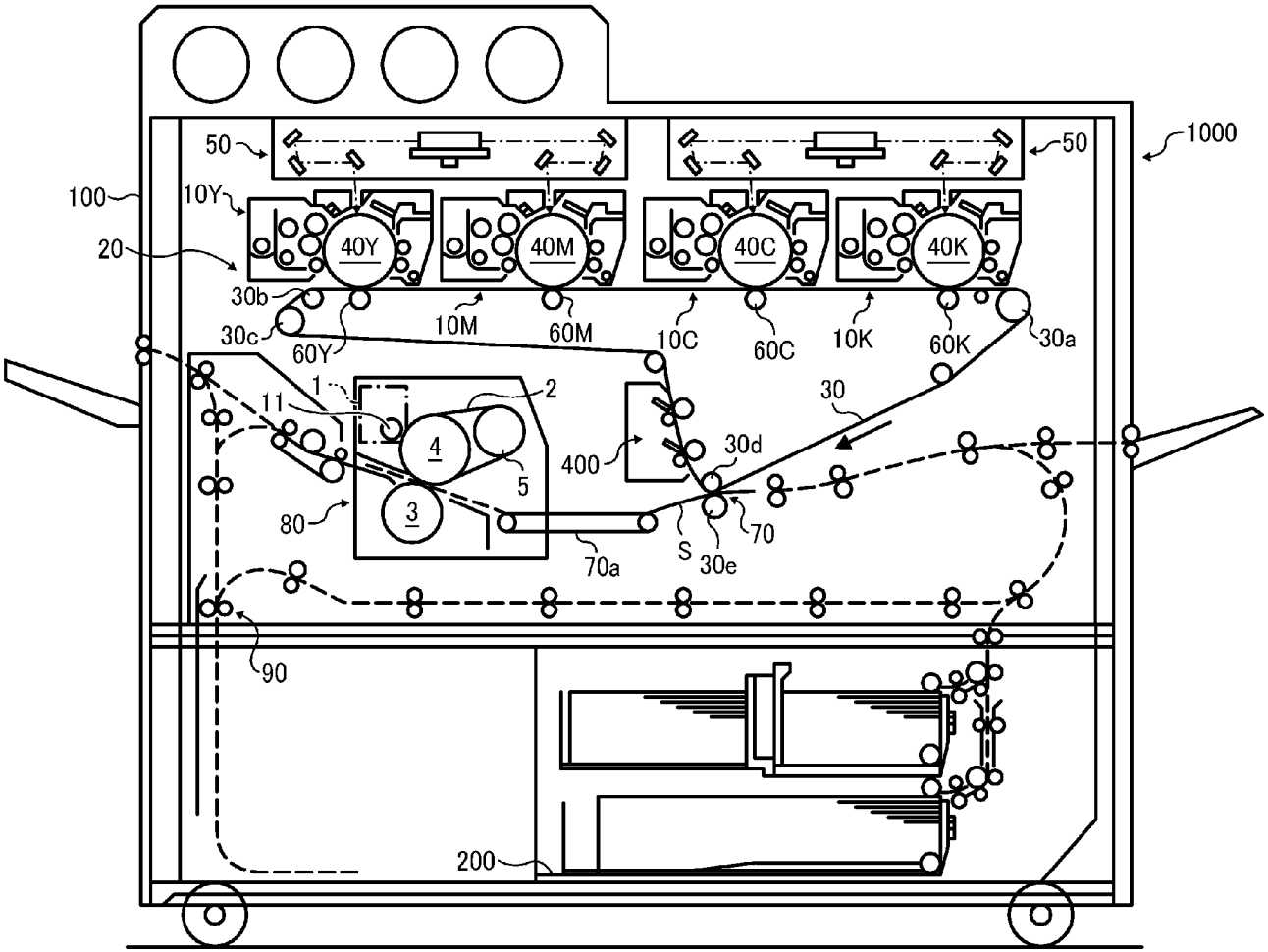
FIG. 1 is a schematic diagram illustrating one example of an image forming apparatus to which an exemplary embodiment of the present invention is applicable.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

At least one exemplary embodiment of the present invention uses a rubbing member to reset a poor-quality image caused by a sheet edge mark generated on a fixing belt.

Degradation of the rubbing member causes abrasion of a shaft core, and such abrasion increases vibration of the rubbing member. Thus, detection of the vibration of the rubbing member is necessary to prevent poor-quality images. The vibration of the rubbing member is detected and controlled to reduce a pressure or a rotation speed (the number of revolutions) of the rubbing member, so that quality of the rubbing member is maintained over time.

That is, according to at least one exemplary embodiment of the present invention, an acceleration sensor as a vibration detector is disposed to a polishing roller, and the polishing roller is operated at a rotation speed that does not generate vibration while maintaining the fixing member in optimum condition to prevent generation of a poor-quality image.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for illustrating the following exemplary embodiments, the same reference numerals are allocated to elements (members or components) having the same function or shape and redundant descriptions thereof are omitted below.

First, a fixing device and an image forming apparatus according to an exemplary embodiment of the present invention are described with reference to FIGS. 1 through 4. FIG. 1 is a schematic diagram illustrating one example of the image forming apparatus to which the exemplary embodiment of the present invention is applicable. In FIG. 1, an image forming apparatus 1000 includes an apparatus body 100 as a tandem intermediate-transfer-type image forming apparatus body, and a sheet feed table 200. The apparatus body 100 is disposed on the sheet feed table 200, and includes a tandem-type image forming unit 20 in which a plurality of image forming units 10Y, 10M, 10C, and 10K are arranged side by side. The suffixes Y, M, C, and K to the numerical values respectively indicate yellow, magenta, cyan, and black.

The apparatus body 100 includes an intermediate transfer belt 30 near the center thereof. The intermediate transfer belt 30 of an endless belt is looped around rollers such as a plurality of support rollers 30*a*, 30*b*, 30*c*, and 30*d*, and is rotatable clockwise in FIG. 1. In the example diagram illustrated in FIG. 1, a cleaning device 400 for the intermediate transfer belt 30 is disposed on the left side of the support roller 30*d*. The cleaning device 400 removes a residual toner remaining on the intermediate transfer belt 30 after an image is transferred.

Moreover, on the intermediate transfer belt 30 looped between the support roller 30*a* and the support roller 30*b*, the four image forming units 10Y, 10M, 10C, and 10K are aligned along a direction of movement of the intermediate transfer belt 30. This forms the tandem-type image forming unit 20. The image forming units 10Y, 10M, 10C, and 10K of the tandem-type image forming unit 20 respectively include photoconductor drums 40Y, 40M, 40C, and 40K that bear toner images of respective colors of yellow, magenta, cyan, and black.

As illustrated in FIG. 1, two exposure devices 50 are disposed above the tandem-type image forming unit 20. Each of the exposure devices 50 corresponds to two image forming units. One of the exposure devices 50 corresponds to the image forming units 10Y and 10M, whereas the other exposure device 50 corresponds to the image forming units 10C and 10K. For example, the exposure device 50 employs an optical-scanning-method, and includes two light source devices, a coupling optical system, a shared optical deflector, and a scanning imaging forming optical system of a two system. For example, the two light sources include semiconductor laser light sources, semiconductor laser array light sources, or multi-beam light sources. The shared optical deflector includes a polygon mirror, for example. The exposure devices 50 irradiate the photoconductor drums 40Y, 40M, 40C, and 40K with light according to image information of yellow, magenta, cyan, and black to form respective electrostatic latent images.

Moreover, each of the image forming units 10Y, 10M, 10C, and 10K includes a charging device. The charging devices uniformly charge the respective photoconductor drums 40Y, 40M, 40C, and 40K prior to the irradiation of the photoconductor drums 40Y, 40M, 40C, and 40K with light. Moreover, the image forming units 10Y, 10M, 10C, and 10K include developing devices that use the respective colors of toner to develop the electrostatic latent images formed by the exposure devices 50, and photoconductor cleaning devices that removes residual toner from the respective photoconductor drums 40Y, 40M, 40C, and 40K. Moreover, the image forming units 10Y, 10M, 10C, and 10K respectively include primary transfer rollers 60Y, 60M, 60C, and 60K in primary transfer positions in which toner images are transferred from the photoconductor drums 40Y, 40M, 40C, and 40K to the intermediate transfer belt 30. The primary transfer rollers 60Y, 60M, 60C, and 60K are disposed opposite the respective photoconductor drums 40Y, 40M, 40C, and 40K with the intermediate transfer belt 30 therebetween.

Among the plurality of support rollers for supporting the intermediate transfer belt 30, the support roller 30*a* serves as a drive roller for rotating the intermediate transfer belt 30. The support roller 30*a* is connected to a motor via a drive transmission unit (e.g., a gear, a pulley, and a belt). Moreover, when a single color image of black is formed on the intermediate transfer belt 30, a moving unit moves the support rollers 30*b* and 30*c*. Herein, the support roller 30*a* is not moved. The movement of the support rollers 30*b* and 30*c* enables the photoconductor drums 40Y, 40M, and 40C for yellow, magenta, and cyan to be separated from the intermediate transfer belt 30.

A secondary transfer unit 70 is disposed at a side opposite the tandem-type image forming unit 20 with the intermediate transfer belt 30 therebetween. In the example diagram illustrated in FIG. 1, the secondary transfer unit 70 presses a secondary transfer roller 30*e* against the support roller 30*d* to apply a transfer electric field, thereby transferring the image on the intermediate transfer belt 30 to a transfer sheet S as a "recording medium". Moreover, a fixing device 80 that fixes the image transferred to the transfer sheet S is disposed near the secondary transfer unit 70. The fixing device 80 includes a rubbing unit 1, a fixing belt 2, a pressure roller 3, a fixing roller 4, and a heating roller 5.

The transfer sheet S including the image transferred by the secondary transfer unit 70 is conveyed to the fixing device 80 by a conveyance belt 70*a* that is supported by two rollers. The fixing device 80 allows the transfer sheet S with unfixed toner to pass between the fixing belt 2 (and the fixing roller 4) heated by the heating roller 5 and the pressure roller 3, so that the toner image is fixed on the transfer sheet S with heat and pressure. A stationary guide member or a conveyance roller may be used instead of the conveyance belt 70*a*. In the example diagram illustrated in FIG. 1, a sheet reverse unit 90 is disposed below the secondary transfer unit 70 and the fixing device 80 and parallel to the tandem-type image forming unit 20. The sheet reverse unit 90 reverses the transfer sheet S and conveys the reversed transfer sheet S, so that images are recorded on both sides of the transfer sheet S.

Figure 2:
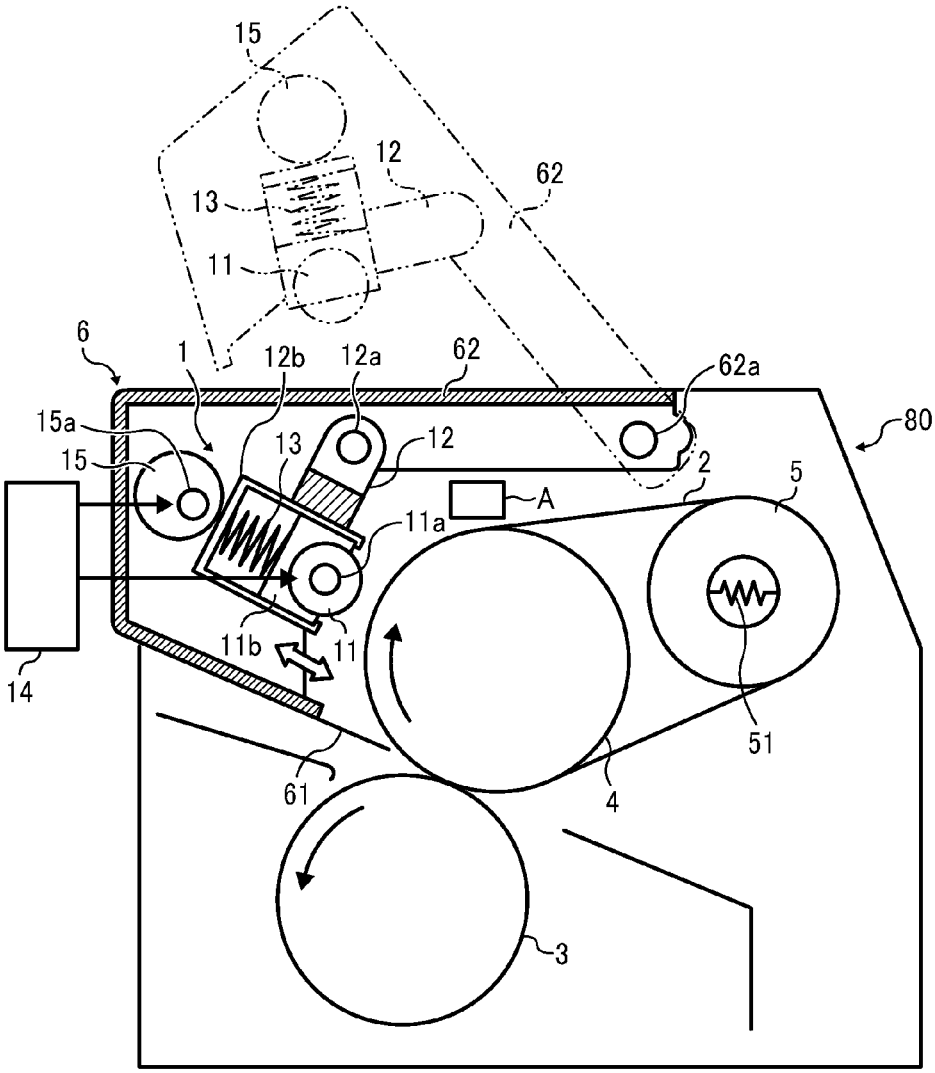
FIG. 2 is a sectional view of a fixing device of the image forming apparatus of FIG. 1.

FIG. 2 is a sectional view of the fixing device 80. As illustrated in FIG. 2, the fixing device 80 includes the rubbing unit 1 including a polishing roller 11, the fixing belt 2 of the endless belt as "a fixing member", the pressure roller 3 of a rotator as "a pressure member (an opposite member)", the fixing roller 4, and the heating roller 5. The fixing belt 2 is looped around the fixing roller 4 and the heating roller 5, and the heating roller 5 includes a heater 51 as a "heating member". The fixing belt 2 is heated via the heating roller 5 heated by the heater 51. Accordingly, the fixing member includes the heating member. The heating member can be a halogen lamp or an electromagnetic-induction heater.

Moreover, the fixing device 80 includes a separation unit 6 in which the rubbing unit 1 is disposed. That is, the rubbing unit 1 is positioned in a space provided in an upper portion of a separation plate 61 of the separation unit 6. The use of the space enables the rubbing unit 1 to be disposed inside the fixing device 80 without an increase in size of the fixing device 80. Herein, the rubbing unit 1 disposed in the separation unit 6 includes the polishing roller 11 as "a rubbing member". The polishing roller 11 is disposed in a readily detachable manner, and is replaceable with a new one after a predetermined period of use.

With a broken line illustrated in FIG. 2, the separation unit 6 is rotatable in a direction away from the fixing belt 2 (the fixing member) around a rotation fulcrum 62*a* of a frame 62. For example, in a case where a sheet jam occurs near an exit of the fixing device 80, operation of the separation unit 6 can facilitate removal of the jammed sheet from the fixing member of the fixing device 80. Moreover, since the separation unit 6 is secured with a screw (e.g., a screw as the rotation fulcrum 62*a*) with respect to the fixing device 80, removal of the screw can remove the separation unit 6 from the fixing device 80. With such a configuration, the polishing roller 11 disposed inside the separation unit 6 can be replaced more easily.

The polishing roller 11 is attached to a sliding bracket 12 with a drive shaft 11*a* being rotatably supported by a bearing 11*b*. More particularly, the sliding bracket 12 is rotatably supported by the frame 62 of the separation unit 6 via the rotation fulcrum 12*a*, and the bearing 11*b* of the polishing roller 11 and a pressure spring 13 are arranged inside a holder 12*b* of the sliding bracket 12. The drive shaft 11*a* of the polishing roller 11 is rotated by a driving force from a drive controller 14 as a "rubbing operation controller". Moreover, a contact and separation cam 15 is disposed at an end of the holder 12*b*, and a drive shaft 15*a* of the contact and separation cam 15 is rotated by a driving force from the drive controller 14.

The drive controller 14 includes a microprocessor and a drive circuit for driving a motor. If an acceleration sensor A detects vibration of the polishing roller 11, the contact and separation cam 15 is rotated to an angle, that is, toward a direction in which a contact pressure of the polishing roller 11 to a surface of the fixing belt 2 is reduced. The contact and separation cam 15 is rotated until reaching a position where the vibration of the polishing roller 11 becomes tolerable. On the other hand, if the acceleration sensor A does not detect vibration, the contact and separation cam 15 is rotated to an angle, that is, toward a direction in which a contact pressure of the polishing roller 11 to a surface of the fixing belt 2 is increased, until the vibration becomes tolerable.

In addition, adjustment of a rotation speed of the polishing roller 11 can reduce the vibration. That is, if the acceleration sensor A detects vibration of the polishing roller 11, the rotation speed of the polishing roller 11 is reduced until the vibration of the polishing roller 11 becomes tolerable. On the other hand, if the acceleration sensor A does not detect vibration of the polishing roller 11, a rotation speed of the polishing roller 11 is increased until the vibration becomes tolerable. The acceleration sensor A detects vibration of the polishing roller 11, so that a rotation speed and a force of a refresh roller are controlled. Accordingly, with the rotation of the contact and separation cam 15, the sliding bracket 12 is rotated around a rotation fulcrum 12*a*. Hence, the polishing roller 11 supported by the sliding bracket 12 becomes contactably separatable with respect to the fixing belt 2 as indicated by a white arrow shown in FIG. 2. That is, the polishing roller 11 can be contacted against and separated from the fixing belt 2. The contact pressure of the polishing roller 11 to the surface of the fixing belt 2 is determined according to a rotation position of the contact and separation cam 15 and a spring force of the pressure spring 13. Thus, the contact pressure to the surface of the fixing belt 2 is controlled by the drive controller 14. The drive controller 14 selects a different contact pressure as described below. Moreover, the drive controller 14 controls the polishing roller 11 and variable rotation speed of the polishing roller 11.

Figure 4:
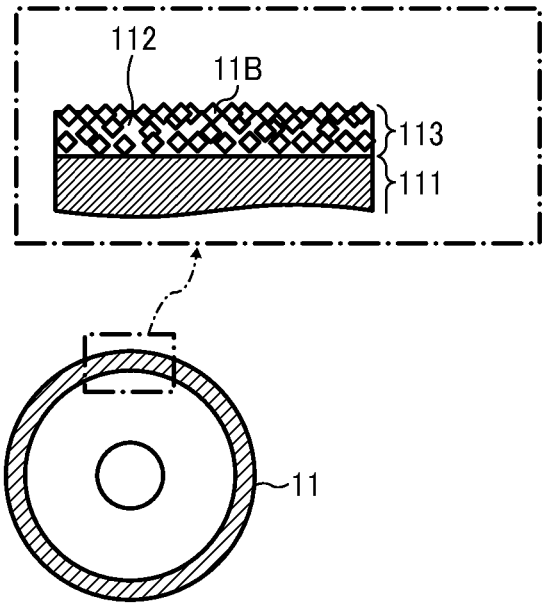
FIG. 4 is a diagram illustrating a sectional shape of a polishing roller as a rubbing member.

Such configurations can rotate the polishing roller 11 in a state in which the polishing roller 11 is in contact with the fixing belt 2, so that the fixing belt 2 can be polished by the polishing roller 11. Therefore, the polishing roller 11 can maintain a surface of the fixing member in optimum condition of the fixing belt 2. As for the polishing roller 11, as illustrated in FIG. 4, a roller that includes a metal core 111 and an abrasive grain layer 113 including abrasive grains 11B dispersed into a binder resin 112 can be used. The abrasive grain layer 113 is formed on the metal core 111. The abrasive grain layer 113 can include aluminum oxide (alumina) that is widely used as an abrasive. A sectional shape of the polishing roller 11 is described in detail below.

In a case where approximately 1000 sheets of the same size are fed, abrasion of a fixing belt caused by edges of the sheets is observed. If a larger sheet is fed afterward, a sheet edge mark is generated on an image. However, in a case where the fixing belt is polished over time to deal with such a problem, a rubbing member is vibrated and image quality is not easily maintained due to such vibration of the rubbing member.

Figure 3:
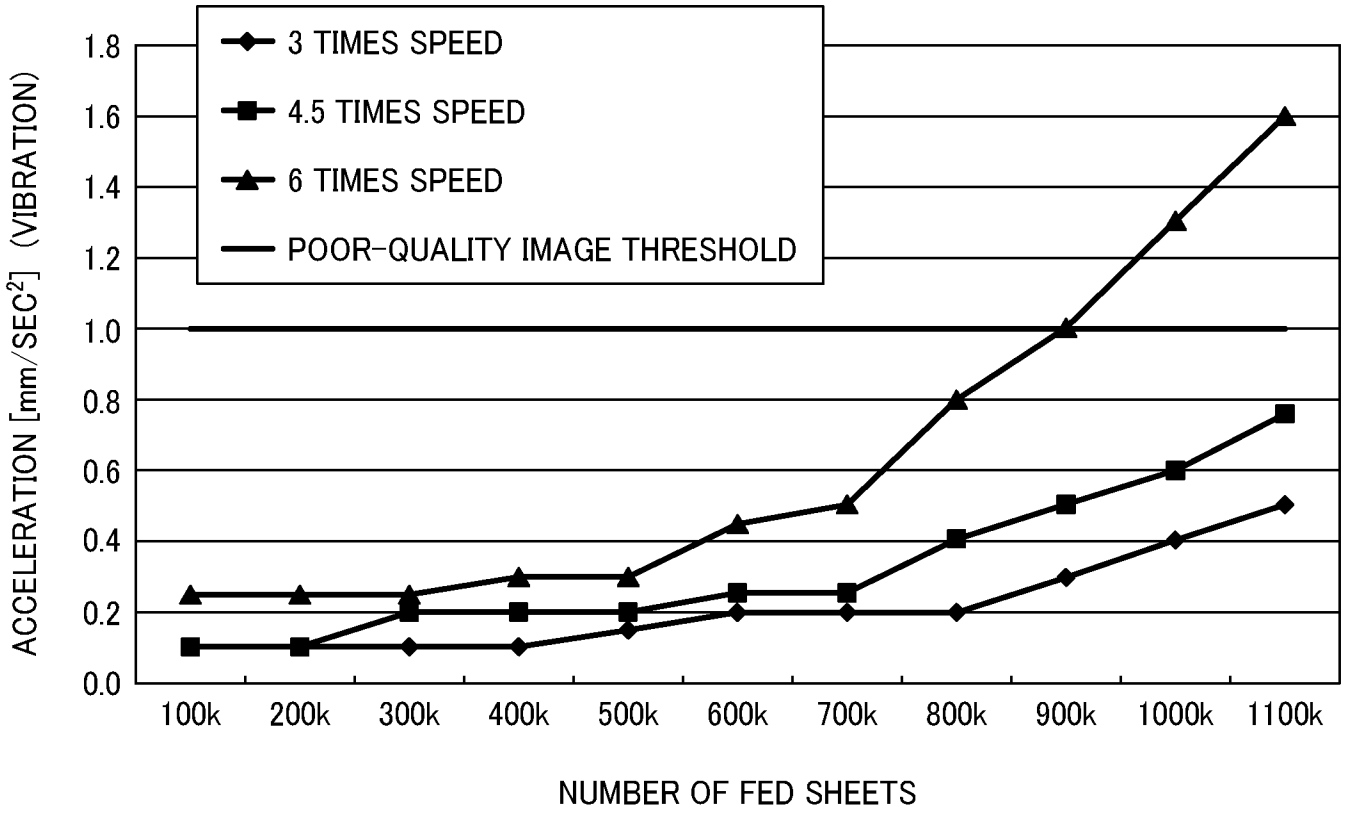
FIG. 3 is a diagram illustrating a relation between the number of fed sheets and acceleration (vibration)

FIG. 3 is a diagram illustrating a relation between the number of fed sheets and acceleration (vibration), that is, an example of vibration that occurs over time. If the vibration is 1 or below, a streak that is not visible is generated on an image. In FIG. 3, the term "TIMES SPEED" represents how many times the rotation speed of the refresh roller is higher than that of the fixing member.

Hereinafter, specification examples of the components of the fixing device 80 are described. In FIG. 2, the fixing device 80 including the aforementioned configurations is illustrated. However, the fixing device 80 may include a halogen heater inside the fixing roller 4 without the fixing belt 2 and the heating roller 5. In such a case, the fixing roller 4 serves as a "fixing member". Moreover, the fixing device 80 may include a heart source of an induction heater (IH). The fixing belt 2 includes a multilayer endless belt including a base layer, an elastic layer, and a release layer. The base layer made of a polyimide (PI) resin has a thickness of approximately 90 μm. The elastic layer and the release layer are sequentially laminated on the base layer. The elastic layer of the fixing belt 2 has a thickness of approximately 200 μm, and is made of an elastic material such as silicone rubber, fluoro rubber, or foamable silicone rubber. The release layer of the fixing belt 2 has a thickness of approximately 20 μm, and is made of, for example, perfluoroalkoxy (PFA), polyimide, polyetherimide, and polyether sulfide (PES). Arrangement of the release layer on a surface layer of the fixing belt 2 can provide good releasability (peelability) with respect to toner (a toner image). This enables not only the toner image on the recording medium to be fixed in a good manner, but also the recording medium with the fixed toner image to be separated from the fixing member in a good manner.

FIG. 4 illustrates a sectional shape of the polishing roller 11 as "a rubbing member". The polishing roller 11 is pressed against the fixing belt 2 with a predetermined contact pressure as described above so as to be rotated in a direction forward or reverse of a rotation direction of the fixing belt 2 with a linear speed difference. The polishing roller 11 includes the metal core 111 and the abrasive grain layer 113 in which the abrasive grains 11B are dispersed into the binder resin 112. A surface of the abrasive grain layer 113 has fine irregularities that are formed by projections of the abrasive grains 11B.

The fixing device according to the exemplary embodiment of the present invention, therefore, a recording medium bearing an unfixed toner is conveyed between the fixing member and a member disposed opposite the fixing member, thereby fixing the toner image on the recording medium. The fixing device includes the rubbing member, which rubs the fixing member to maintain a surface of the fixing member in optimum condition of the fixing member. Such a rubbing operation is controlled by at least a rubbing rotation-speed controller and a rubbing force controller according to vibration as a trigger, and thus quality of the rubbing member is maintained.

Moreover, the rubbing member is contactably separatable with respect to the fixing member, and a rotation speed of the rubbing member is changed in a state in which the rubbing member is in contact with the fixing member such that a contact pressure can be changed. Moreover, a rotation speed of the rubbing member is changed in a state in which the rubbing member is separated from the fixing member such that a contact pressure can be changed. Moreover, a vibration detector can be disposed to detect vibration of the rubbing member. In addition, a rotation speed in a circumferential direction of the rubbing operation controller may be higher than that of the fixing belt. In either case, quality of the rubbing member can be maintained overtime.

Embodiments of the present invention have been described above with reference to specific exemplary embodiments. Note that the present disclosure is not limited to the details of the embodiments described above, but various modifications and enhancements are possible without departing from the scope thereof. It is therefore to be understood that embodiments of the present invention may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing member configured to fix a toner image on a recording medium;

a pressure member opposite the fixing member;

a rubbing member configured to rub the fixing member to maintain a surface of the fixing member;

a detector configured to detect vibration of the rubbing member; and a rubbing operation controller configured to control rubbing of the fixing member with the rubbing member, the rubbing operation controller configured to control a rubbing rotation speed and a rubbing force based on at least the vibration of the rubbing member detected by the detector.

2. The fixing device according to claim 1, wherein the rubbing member is contactably separatable with respect to the fixing member, a rotation speed of the rubbing member is changeable in a state in which the rubbing member is in contact with the fixing member, and a change in the rotation speed of the rubbing member changes a contact pressure of the rubbing member against the fixing member.

3. The fixing device according to claim 1, wherein the rubbing member is contactably separatable with respect to the fixing member, a rotation speed of the rubbing member is changeable in a state in which the rubbing member is separated from the fixing member, and a change in the rotation speed of the rubbing member changes a contact pressure of the rubbing member against the fixing member.

4. The fixing device according to claim 1, wherein the rubbing operation controller controls a rotation speed of the rubbing member in a circumferential direction of the rubbing member to be higher than a rotation speed of the fixing member in a circumferential direction of the fixing member.

5. An image forming apparatus comprising the fixing device of claim 1.

6. The fixing device according to claim 1, wherein the rubbing operation controller is configured to reduce the rubbing rotation speed of the rubbing member based on the vibration of the rubbing member detected by the detector.

7. The fixing device according to claim 1, wherein the rubbing operation controller is configured to reduce the rubbing force of the rubbing member based on the vibration of the rubbing member detected by the detector.

8. The fixing device according to claim 1, wherein the rubbing operation controller is configured to reduce the rubbing rotation speed of the rubbing member and reduce the rubbing force of the rubbing member based on the vibration of the rubbing member detected by the detector.

9. The fixing device according to claim 1, further comprising:

a separation unit configured to separate the rubbing member from the fixing member and provide access to the fixing device for maintenance.

10. The fixing device according to claim 1 further comprising:

a pressure spring configured to press the rubbing member to the fixing member.

11. The fixing device according to claim 1 further comprising:

a separation unit configured to separate the rubbing member from the fixing member and to provide access to the fixing member for maintenance.

12. A fixing device comprising:

a fixing belt configured to fix toner images on a recording medium using heat and pressure;

a fixing roller configured to press the fixing belt against the recording medium;

a pressing roller configured to press the recording medium against the fixing belt opposite the fixing roller;

a heating roller configured to heat the fixing belt wherein the fixing belt is configured to travel around the heating roller and the fixing roller;

a polishing roller configured to polish the fixing belt by rubbing the fixing belt, the polishing roller having a rotation speed and a contact pressure;

a detector configured to detect vibrations of the polishing roller; and a polishing roller operation controller configured to control the rotation speed and the contact pressure of the polishing roller based on the vibrations detected by the detector.

13. The fixing device according to claim 12 further comprising:

a pressure spring configured to press the polishing roller to the fixing belt.

14. The fixing device according to claim 12 wherein a change in the rotation speed of the polishing roller changes a contact pressure of the polishing roller against the fixing belt.

15. The fixing device according to claim 12, wherein the polishing roller operation controller is configured to reduce the rotation speed of the polishing roller based on the vibration of the polishing roller detected by the detector.

16. The fixing device according to claim 12, wherein the polishing roller operation controller is configured to reduce the contact pressure of the polishing roller based on the vibration of the polishing roller detected by the detector.

17. The fixing device according to claim 12, wherein the polishing roller operation controller is configured to reduce the rotation speed and contact pressure of the polishing roller based on the vibration of the polishing roller detected by the detector.

18. The fixing device according to claim 12, further comprising:

a separation unit configured to separate the polishing roller from the fixing belt.

19. The fixing device according to claim 18, wherein the separation unit is configured to separate the polishing roller from the fixing belt by rotating the polishing roller away from the fixing belt.

20. The fixing device according to claim 18, wherein the separation unit is configured to separate allowing access for maintenance on the fixing device.

* * * * *